US009416504B1

(12) United States Patent
Shiota et al.

(10) Patent No.: US 9,416,504 B1
(45) Date of Patent: Aug. 16, 2016

(54) BRIDGE PIER STRUCTURE

(71) Applicant: JFE Civil Engineering & Construction Corporation, Tokyo (JP)

(72) Inventors: Keisuke Shiota, Tokyo (JP); Kazuaki Miyagawa, Tokyo (JP); Hiroyuki Imashio, Tokyo (JP); Hitoshi Naito, Tokyo (JP); Yuya Sakurai, Tokyo (JP); Yasuke Imano, Tokyo (JP)

(73) Assignee: JFE Civil Engineering & Construction Corporation, Tokyo (JP)

( * ) Notice: Subject to any disclaimer, the term of this patent is extended or adjusted under 35 U.S.C. 154(b) by 0 days.

(21) Appl. No.: 14/934,827

(22) Filed: Nov. 6, 2015

(30) Foreign Application Priority Data

Feb. 4, 2015 (JP) ..... 2015-020650

(51) Int. Cl.
*E01D 19/00* (2006.01)
*E01D 19/02* (2006.01)

(52) U.S. Cl.
CPC ..... *E01D 19/02* (2013.01)

(58) Field of Classification Search
CPC ..... E01D 19/02
USPC ..... 14/73, 75, 77.3, 78
See application file for complete search history.

(56) References Cited

FOREIGN PATENT DOCUMENTS

JP 2003-74019 A 3/2003

OTHER PUBLICATIONS espacenet English abstract of JP 2003-74019 A.

*Primary Examiner* — Raymond W Addie
(74) *Attorney, Agent, or Firm* — Ladas & Parry LLP

(57) ABSTRACT

A bridge pier structure includes a damper having damping characteristics, a substructure joined with a lower end portion of the damper, and a pillar member provided upright on the substructure, a side surface of the pillar member being joined with an upper end portion of the damper. The damper is substantially parallel to the side surface of the pillar member.

10 Claims, 12 Drawing Sheets

BRIDGE PIER STRUCTURE

TECHNICAL FIELD

The present invention relates to a bridge pier structure, and more particularly to a bridge pier structure for enhancing the earthquake resistance of a bridge pier of a bridge or a road, a pillar member of a civil engineering structure such as a floodgate, or a pillar member of an architectural structure such as a building.

BACKGROUND ART

Inventions have been disclosed in which, for seismic reinforcement of a pillar member of a civil engineering structure or an architectural structure, diagonal members having hysteresis damping characteristics are disposed in a brace manner between the target pillar member and a footing with the pillar member installed, to thereby support a horizontal load in an earthquake, increase a horizontal load capacity of the pillar member, and reduce horizontal displacement (see Patent Literature 1, for example).

CITATION LIST

Patent Literature

Patent Literature 1: Japanese Unexamined Patent Application Publication No. 2003-74019 (pages 3 to 4 and FIG. 1)

SUMMARY OF INVENTION

Technical Problem

According to the invention disclosed in Patent Literature 1, the diagonal members extend or contract owing to deformation (tilt relative to the footing) of the pillar member in the earthquake. Therefore, the diagonal members exhibit hysteresis damping performance, thereby obtaining an effect of damping vibration of the pillar structure, reducing a seismic load, and enabling efficient seismic reinforcement.

According to this invention, however, the diagonal members are installed to the pillar member in a brace manner to extend laterally from the pillar member, and thus ends of the diagonal members joined to the footing project extensively from the outer circumference of the pillar member. That is, the diagonal members serving as reinforcing members occupy a large area.

Therefore, there is a problem in that the invention is not applicable to a case in which a bridge pier of a bridge, for example, is located close to a space-occupying structure, such as a road, a path, or an embankment. Further, there is another problem in that the invention is not applicable to a case in which the bridge pier is located in a river, a lake, a marsh, or a sea area, for example, since the reinforcing members project extensively to a water area and occupy a large area, thereby obstructing a river basin area, for example.

The present invention provides a bridge pier structure that solves the above-described problems and is capable of reducing the seismic load while curtailing the area occupied by the reinforcing members, without projecting extensively from the outer circumference of the pillar member.

Solution to Problem (1) A bridge pier structure according to the present invention includes a damper having damping characteristics, a substructure joined with a lower end portion of the damper, and a pillar member provided upright on the substructure, a side surface of the pillar member being joined with an upper end portion of the damper. The damper is substantially parallel to the side surface of the pillar member.

(2) Further, in (1) described above, the lower end portion and the upper end portion of the damper each include a damper pin hole, and a substructure bracket including a substructure pin hole is installed to the substructure. A pillar member bracket including a pillar member pin hole is installed to the side surface of the pillar member.

A lower pin inserted in the damper pin hole of the lower end portion of the damper and the substructure pin hole forms a lower pin structure configured to join the damper and the substructure.

An upper pin inserted in the damper pin hole of the upper end portion of the damper and the pillar member pin hole forms an upper pin structure configured to join the damper and the pillar member.

(3) Further, in (1) described above, the pillar member has a rectangular cross section, and the side surfaces of the pillar member are flat surfaces.

A pair of the dampers is disposed parallel to at least one of the side surfaces of the pillar member.

A distance between the upper end portions of the pair of the dampers is different from a distance between the lower end portions of the pair of the dampers.

(4) Further, in (2) described above, the substructure includes a base having an upper surface projecting from ground, and the substructure bracket is provided on the upper surface of the base.

(5) Further, in (1) described above, the damper is an axial damper, a shear damper, a viscoelastic damper, a bending damper, a cylinder-piston damper, a buckling-restrained brace, an unbonded brace, a hysteresis damper, or a friction damper.

(6) Further, in (1) described above, the pillar member has a "cut-off" reinforced concrete structure including a full-length reinforcing bar disposed over a full length of the pillar member in a height direction and a lower reinforcing bar disposed in a lower area of the pillar member in the height direction, and the upper end portion of the damper is joined to the side surface of the pillar member at a position above an upper end of the lower reinforcing bar.

(7) Further, in (1) described above, the damper includes an axial force member, a stiffener stiffening the axial force member, a first connection member connected to one end portion of the axial force member and one end portion of the stiffener, and a second connection member connected to an other end portion of the axial force member.

The axial force member has a length equal to or shorter than a length so that a value of energy absorbed by the pillar member when the damper is not installed to the pillar member and the pillar member deforms from an allowable pillar member displacement allowed for the pillar member to a maximum design displacement determined by design energy of the pillar member is equal to energy absorbed by the damper from start of deformation of the damper to displacement to a displacement corresponding to the allowable pillar member displacement.

(8) Further, in (7) described above, a stopper is formed to project from an outer circumference of the second connection member, and, when the axial force member contracts, the stopper comes into contact with an other end portion of the stiffener.

(9) Further, in (7) described above, a stopper is formed to project from an outer circumference of the second connection member, and an other end portion of the stiffener is formed with a first reaction force portion and a second reaction force portion facing each other across the stopper.

The stopper comes into contact with the first reaction force portion of the stiffener when the axial force member contracts, and the stopper comes into contact with the second reaction force portion of the stiffener when the axial force member extends.

(10) Further, in (8) described above, the stiffener is stiffened by a second stiffener, and one end portion of the second stiffener is connected to the first connection member.

Advantageous Effects of Invention (i) In the bridge pier structure according to the present invention, the dampers having the damping characteristics have end portions each joined to the respective side surfaces of the pillar member provided upright on the substructure (bridge pier side surfaces of a bridge pier provided upright on a footing, for example). Therefore, the dampers extend or contract owing to the deformation (tilt relative to the substructure) of the pillar member in an earthquake. Thus, a vibration damping effect is obtained, a seismic load is reduced, and efficient seismic reinforcement is provided.

Further, since the dampers are installed substantially parallel to the side surfaces of the pillar member, the dampers do not project extensively from the outer circumference of the pillar member, and the area occupied by the dampers serving as reinforcing members is small. Thus, the bridge pier structure according to the present invention is also applicable to a case in which the bridge pier is located close to a space-occupying structure, such as a road, a path, or an embankment, for example, and a case in which the bridge pier is located in a river, a lake, a marsh, or a sea area, for example.

(ii) Further, since the pillar member, the dampers, and the substructure are joined together by the pin structures, the dampers are subjected only to force acting in the axial direction thereof and not to force that bends the dampers. Therefore, the designing of the dampers is simplified, and the damping characteristics of the dampers are sufficiently exhibited.

(iii) Since the pair of the dampers is parallel to the flat side surface of the pillar member and arranged in a triangular or trapezoidal shape, the effect of damping earthquake vibration in a direction parallel to the side surface is obtained by the pair of the dampers. That is, since it is possible to limit the side surface of the pillar member to which the dampers are installed, the degree of freedom is increased in selecting the side surface to which the dampers are installed. It is therefore possible to improve the appearance by not installing the dampers to some of the side surfaces.

(iv) Further, the lower end portions of the dampers are connected to the substructure brackets provided on the upper surfaces of the bases projecting from the ground, and the dampers are separated from the ground. Therefore, the corrosion of the dampers is suppressed, and the replacement of the dampers is simplified.

(v) Further, the dampers have the hysteresis damping characteristics, and are commonly used. Therefore, the dampers are easily selected and procured, and make it possible to manufacture the bridge pier structure at low cost.

(vi) Further, the pillar member has the cut-off reinforced concrete structure, and the upper end portions of the dampers are located at positions higher than a cut-off section. Therefore, the area of the pillar member higher than the cut-off section is also reinforced and improved in earthquake resistance. In addition, the area occupied by the dampers serving as the reinforcing members is small, and thus restrictions on installation sites are reduced.

(vii) Further, the axial force member has the length equal to or shorter than the length so that the value of the energy absorbed by the pillar member when the pillar member deforms from the allowable pillar member displacement to the maximum design displacement is equal to the energy absorbed by the dampers until the displacement to an allowable damper displacement corresponding to the allowable pillar member displacement. Therefore, the earthquake resistance is more reliably improved.

(viii) Further, the stopper is provided, and the axial force member and the stiffener both support compression force. Therefore, the buckling of the axial force member is prevented, and the earthquake resistance is improved.

(ix) Further, since the stopper is provided and the axial force member and the stiffener both support the compression force, the buckling of the axial force member is prevented. Further, since the axial force member and the stiffener both support tensile force, a plastic deformation amount of the axial force member is reduced, and the earthquake resistance is improved.

(x) Further, since the second stiffener is provided, the buckling of the axial force member is more reliably suppressed, and the earthquake resistance is further improved.

DESCRIPTION OF EMBODIMENTS

Embodiment 1

Figure 1:
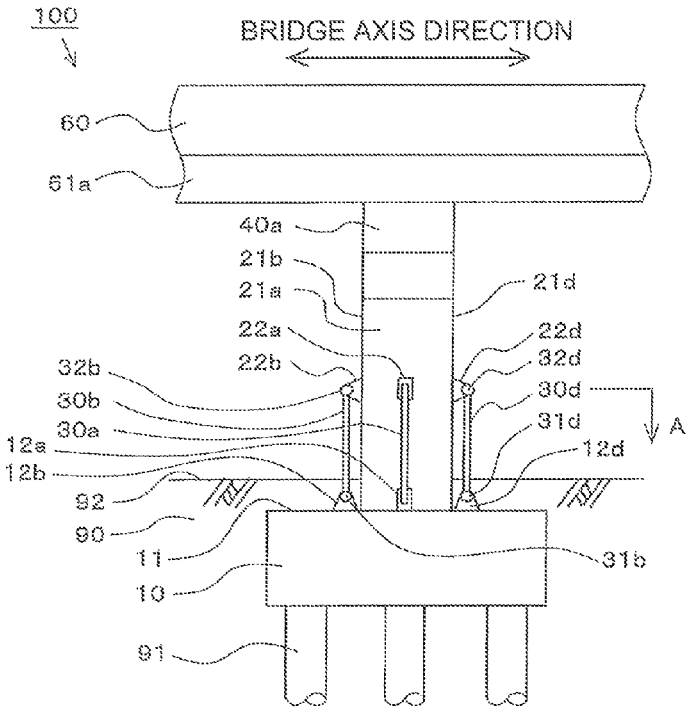
FIG. 1 is a side view illustrating a bridge pier structure according to Embodiment 1 of the present invention.
Figure 2:
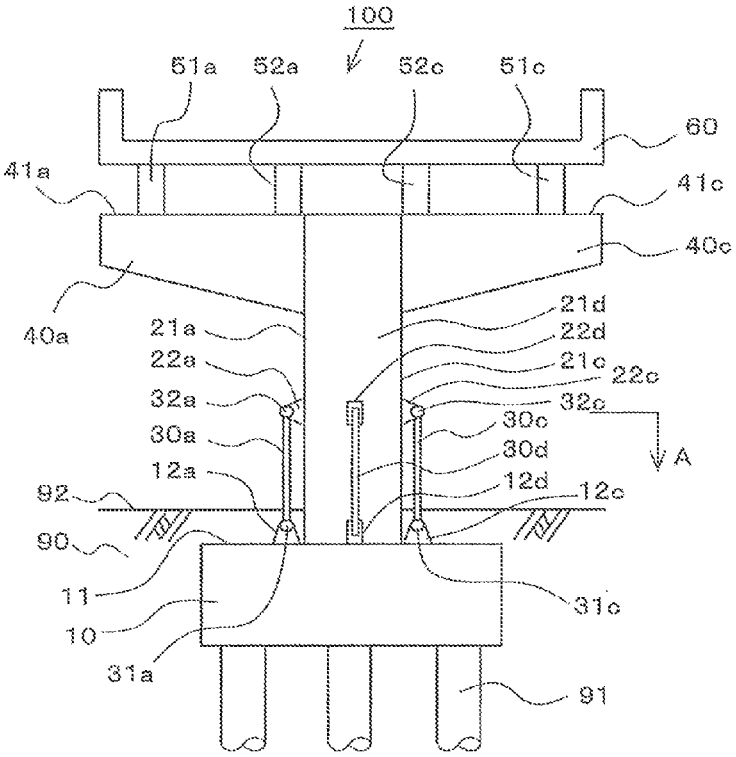
FIG. 2 is a front view illustrating the bridge pier structure according to Embodiment 1 of the present invention.
Figure 3:
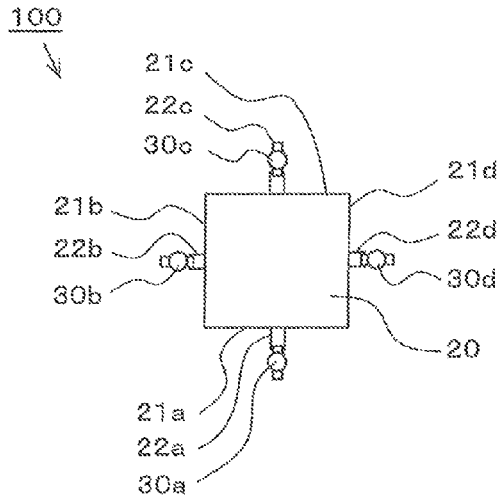
FIG. 3 is a cross-sectional view of a plan view illustrating the bridge pier structure according to Embodiment 1 of the present invention (along arrow A in FIG. 1).

FIGS. 1 to 3 illustrate a bridge pier structure according to Embodiment 1 of the present invention. FIG. 1 is a side view, FIG. 2 is a front view, and FIG. 3 is a cross-sectional view of a plan view (along arrow A in FIG. 1). Respective parts are schematically illustrated, and the present invention is not limited to the illustrated embodiment (in shape and relative size).

(Bridge Pier Structure)

In FIGS. 1 to 3, a bridge pier structure 100 has dampers 30*a*, 30*b*, 30*c*, and 30*d* having damping characteristics and having respective lower end portions joined to an upper surface 11 of a footing (same as substructure) 10 and respective upper end portions joined to bridge pier side surfaces 21*a*, 21*b*, 21*c*, and 21*d* of a bridge pier (same as pillar member) 20 provided upright on the footing 10.

Herein, the dampers 30*a*, 30*b*, 30*c*, and 30*d* are substantially parallel to the bridge pier side surfaces 21*a*, 21*b*, 21*c*, and 21*d*, respectively. In the following description of members having the same structure, the suffixes "a," "b," "c," and "d" added to the reference signs of the members and parts may be omitted for the convenience of description.

Although the bridge pier structure 100 includes the bridge pier 20 as a pillar member, the present invention is not limited thereto, and may include a pillar member installed on a substructure to support a superstructure.

The lower end portions and the upper end portions of the dampers 30 include not-illustrated damper pin holes. Meanwhile, footing brackets 12 including not-illustrated footing pin holes are installed to the upper surface 11 of the footing 10, and bridge pier brackets (same as pillar member brackets) 22 including not-illustrated pier pin holes are installed to the bridge pier side surfaces 21 of the bridge pier 20.

Further, lower pins 31 inserted in the not-illustrated damper pin holes of the lower end portions of the dampers 30 and the not-illustrated footing pin holes form footing-side pin structures that join the dampers 30 and the footing 10.

Further, upper pins 32 inserted in the not-illustrated damper pin holes of the upper end portions of the dampers 30 and the not-illustrated pier pin holes form pier-side pin structures that join the dampers 30 and the bridge pier 20.

The footing 10 is buried in ground 90 with the upper surface 11 of the footing 10 located below a surface of the ground 90 (hereinafter referred to as the "ground surface 92"), and is supported by multiple piles 91 placed in the ground 90.

Further, beams 40*a* and 40*c* are installed on the bridge pier side surfaces 21*a* and 21*c*, respectively, and girders 51*a* and 52*a* and girders 51*c* and 52*c* are installed on an upper surface 41*a* of the beam 40*a* and an upper surface 41*c* of the beam 40*c*, respectively, and support a floorboard (same as superstructure) 60. Therefore, the bridge pier side surfaces 21*a* and 21*c* are parallel to a bridge axis direction (indicated by arrow).

(Operations)

Figure 4:
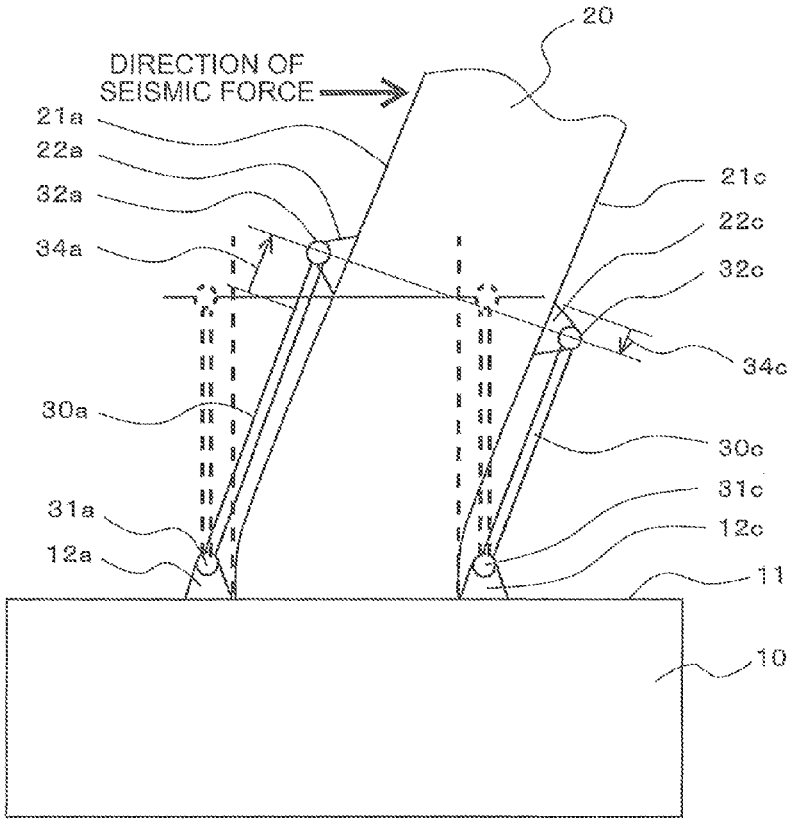
FIG. 4 is a front view illustrating the bridge pier structure according to Embodiment 1 of the present invention, depicting deformation of the bridge pier structure in an earthquake.
Figure 5:
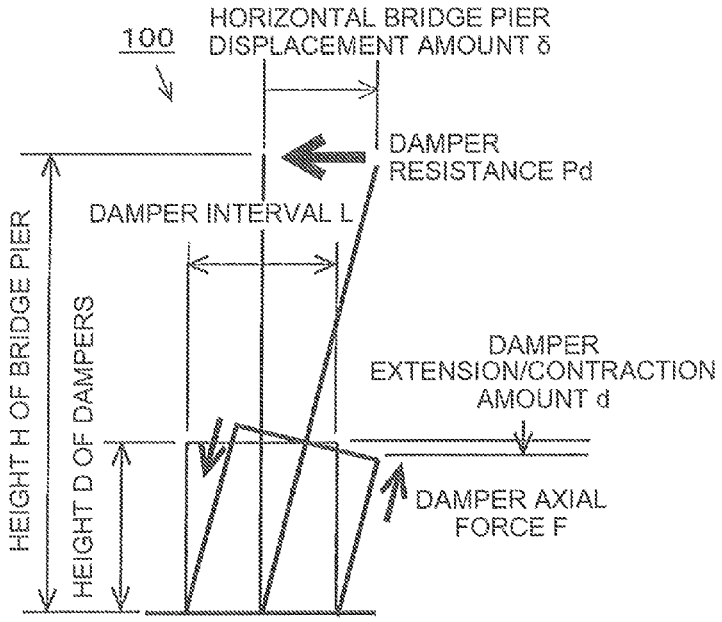
FIG. 5 is a front view illustrating the bridge pier structure according to Embodiment 1 of the present invention, depicting the relationship between force acting in the earthquake and a deformation amount.
Figure 6:
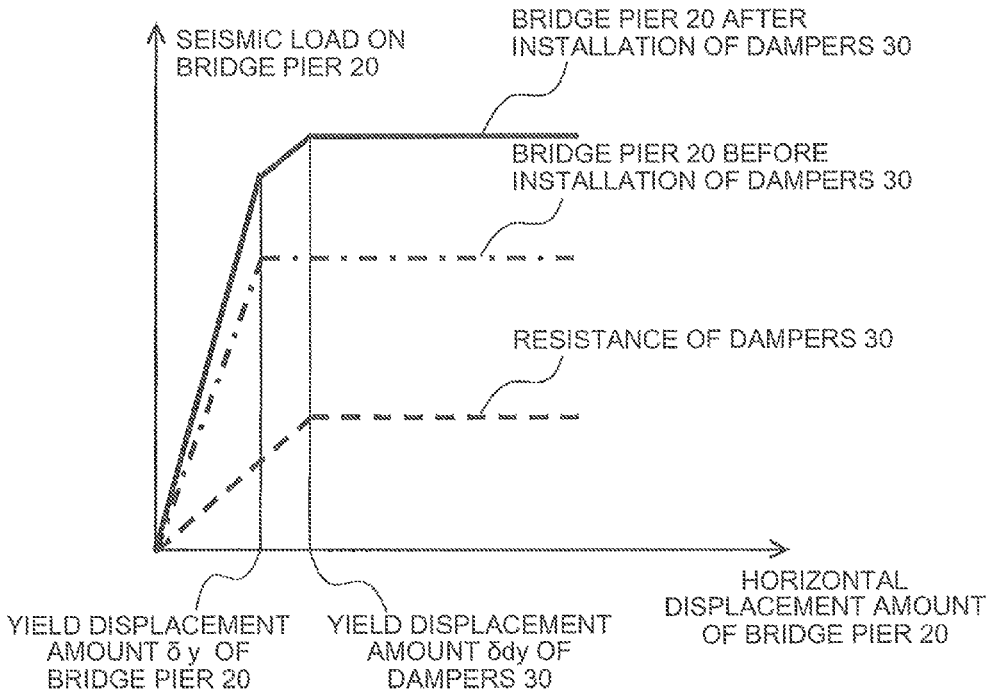
FIG. 6 is a correlation diagram illustrating the bridge pier structure according to Embodiment 1 of the present invention, depicting the relationship between a seismic load and a horizontal displacement amount.

FIGS. 4 to 6 illustrate the bridge pier structure according to Embodiment 1 of the present invention. FIG. 4 is a front view depicting deformation of the bridge pier structure in an earthquake. FIG. 5 is a front view depicting the relationship between force acting in the earthquake and a deformation amount. FIG. 6 is a correlation diagram depicting the relationship between a seismic load and a horizontal displacement amount. Respective parts are schematically illustrated, and the same parts as the parts illustrated in FIGS. 1 to 3 are designated by the same reference signs.

In FIG. 4, the bridge pier 20 (the bridge pier side surfaces 21*a* and 21*c*) is installed perpendicularly to the upper surface 11 of the footing 10 before the occurrence of the earthquake. Thus, the damper 30*a* (a line connecting the center of the lower pin 31*a* and the center of the upper pin 32*a*) and the damper 30*c* (a line connecting the center of the lower pin 31*c* and the center of the upper pin 32*c*) are perpendicular to the upper surface 11 (both indicated by broken lines).

Then, as the earthquake occurs, an area of the bridge pier 20 close to the lower end thereof is bent to tilt relative to the upper surface 11 of the footing 10, and the bridge pier side surface 21*a* extends and the bridge pier side surface 21*c* contracts. Thus, the upper end portion of the damper 30*a* (the upper pin 32*a*) moves diagonally upward, and thus the damper 30*a* extends by a distance (hereinafter referred to as "extension amount") 34*a*. Meanwhile, the upper end portion of the damper 30*c* moves diagonally downward, and thus the damper 30*c* contracts by a distance (hereinafter referred to as "contraction amount") 34*c*.

In FIG. 5, the relationship between seismic force acting on a head portion of the bridge pier 20 (hereinafter referred to as the "damper resistance Pd") and force acting on the dampers 30 (hereinafter referred to as the "damper axial force F") is obtained. The height of the bridge pier 20 is represented as "H," the displacement amount in the horizontal direction of the head portion of the bridge pier 20 (same as horizontal bridge pier displacement amount) is represented as "δ," the height of the dampers 30 is represented as "D," the interval between the dampers 30*a* and 30*c* is represented as "L," and the extension amount of the damper 30*a* (same as the contraction amount of the damper 30*c*) is represented as "d."

Herein, bending moment due to the damper resistance Pd and bending moment due to the damper axial force F are balanced, and "Pd×H=F×L" holds. Therefore, the damper resistance Pd is calculated from "Pd=F×L/H." That is, the damper resistance Pd is increased as the installation interval L between the dampers 30 is increased (widened).

Further, since the extension amount d of the damper 30*a* and the horizontal bridge pier displacement amount δ of the head portion of the bridge pier 20 have a relationship "δ/H=2×d/L," the horizontal bridge pier displacement amount δ is calculated from "δ=2×d×H/L."

When the cross section area and the modulus of elasticity of the dampers 30 are represented as "A" and "E," respectively, the extension amount d of the damper 30*a* is calculated from "d=F×D/(A×E)" based on "F=A×E×d/D."

In FIG. 6, the vertical axis represents the seismic load acting on the bridge pier 20, and the horizontal axis represents the horizontal bridge pier displacement amount (δ) of the bridge pier 20. In FIG. 6, as to the bridge pier 20 before the dampers 30 are installed, the seismic load is elastically and gradually increased until the horizontal bridge pier displacement amount (δ) reaches a displacement amount at which the bridge pier 20 yields (hereinafter referred to as the "bridge pier yield displacement amount δy"), and the seismic load remains at a constant value after the horizontal bridge pier displacement amount (δ) reaches the bridge pier yield displacement amount δy, irrespective of the increase in the horizontal bridge pier displacement amount (δ).

Meanwhile, as to the dampers 30 per se, the seismic load is elastically and gradually increased until the horizontal bridge pier displacement amount (δ) reaches a displacement amount at which the dampers 30 yield (hereinafter referred to as the "damper yield displacement amount δdy"), and the seismic load remains at a constant value after the horizontal bridge pier displacement amount (δ) reaches the damper yield displacement amount δdy, irrespective of the increase in the horizontal bridge pier displacement amount (δ).

Herein, the damper yield displacement amount δdy is larger in value than the bridge pier yield displacement amount δy.

As to the bridge pier 20 to which the dampers 30 are installed, therefore, the behavior of the bridge pier 20 before the dampers 30 are installed and the behavior of the dampers 30 alone are combined to form a behavior indicated by a solid line in FIG. 6.

In this case, the following holds:

The extension/contraction amount (extension amount d=contraction amount d) of the dampers 30 at the time of yielding is proportional to the height D of the dampers 30.

It is possible to adjust the horizontal bridge pier displacement amount δ, which is an extension/contraction amount at the time of yielding, by adjusting the height D of the dampers 30.

It is possible to adjust the timing of yielding of the dampers 30 relative to the horizontal bridge pier displacement amount δ at the time of yielding of the bridge pier 20 by adjusting the height D of the damper 30.

Adjustment for preventing the dampers 30 from yielding is possible by adjusting the height D of the dampers 30, if the bridge pier 20 is in the range of elasticity.

As described above, the bridge pier structure 100 provides efficient seismic reinforcement of the bridge pier 20. Further, the dampers 30 do not project extensively from the bridge pier side surfaces 21 of the bridge pier 20, and the area occupied by the dampers 30 serving as reinforcing members is small. The bridge pier structure 100 is therefore applicable to a case in which the bridge pier 20 is located close to a space-occupying structure, such as a road, a path, or an embankment, for example, and a case in which the bridge pier 20 is located in a river, a lake, a marsh, or a sea area, for example.

Further, since the dampers 30 are joined by the pin structures, the dampers 30 are subjected only to the force in the axial direction thereof and not to force that bents the dampers 30. Thus, the designing of the dampers 30 is simplified, and the damping characteristics of the dampers 30 are sufficiently exhibited.

Further, the dampers 30 are not limited to the one described above as long as the dampers 30 have the damping characteristics, and the dampers 30 are commonly used. Thus, the dampers 30 are easily selected and procured, and it is possible to manufacture the bridge pier structure 100 at low cost.

Embodiment 2

Figure 7A:
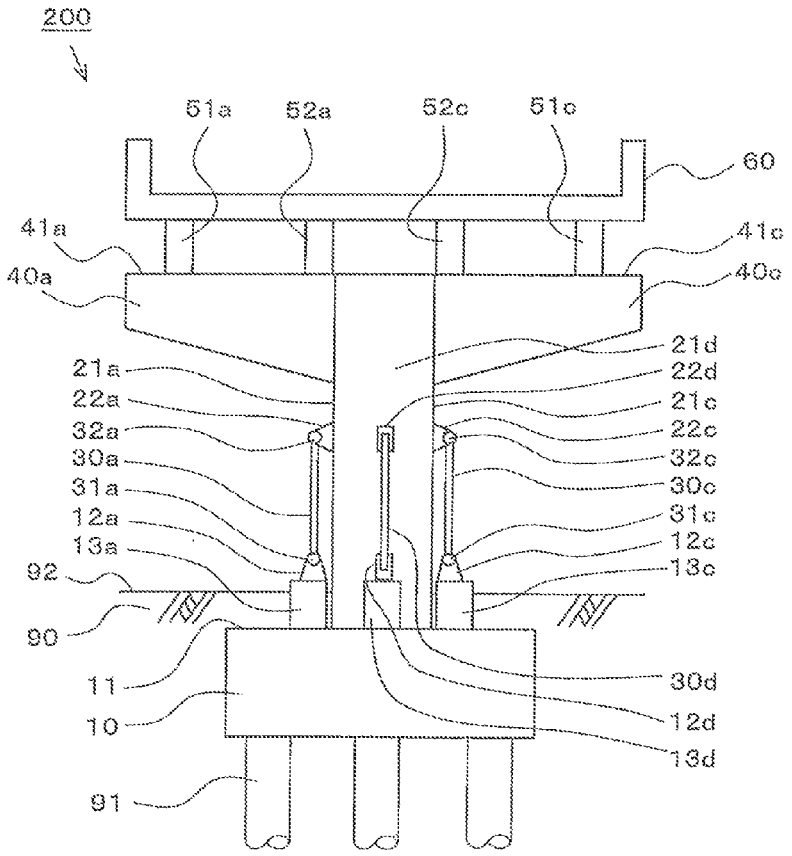
FIG. 7A is a front view illustrating a bridge pier structure according to Embodiment 2 of the present invention.
Figure 7B:
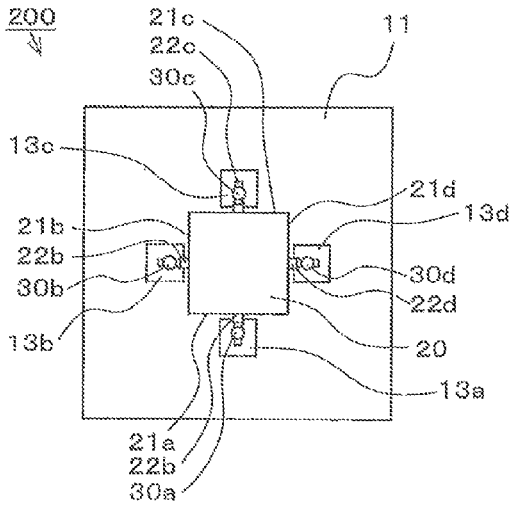
FIG. 7B is a plan view illustrating the bridge pier structure according to Embodiment 2 of the present invention, depicting parts of the bridge pier structure.

FIG. 7A is a front view illustrating a bridge pier structure according to Embodiment 2 of the present invention. FIG. 7B is a plan view illustrating the bridge pier structure according to Embodiment 2 of the present invention, depicting parts of the bridge pier structure. Parts the same as or corresponding to those in Embodiment 1 are designated by the same reference signs, and description of parts thereof will be omitted. Further, respective parts are schematically illustrated, and the present invention is not limited to the illustrated embodiment (in shape and relative size).

(Bridge Pier Structure)

In FIGS. 7A and 7B, a bridge pier structure 200 includes bases 13*a*, 13*b*, 13*c*, and 13*d* standing on the upper surface 11 of the footing 10, and footing brackets 12*a*, 12*b*, 12*c*, and 12*d* are installed on the bases 13*a*, 13*b*, 13*c*, and 13*d*. The configurations other than these points are the same as those in the bridge pier structure 100 (Embodiment 1).

In this case, respective upper surfaces of the bases 13*a*, 13*b*, 13*c*, and 13*d* project upward from the ground surface 92, and thus the footing brackets 12*a*, 12*b*, 12*c*, and 12*d* are exposed above the ground surface 92.

Thus, the corrosion of the dampers 30 is prevented, and it is unnecessary to dig the ground 90 when the dampers 30 themselves or members forming the dampers 30 are to be replaced.

Embodiment 3

Figure 8:
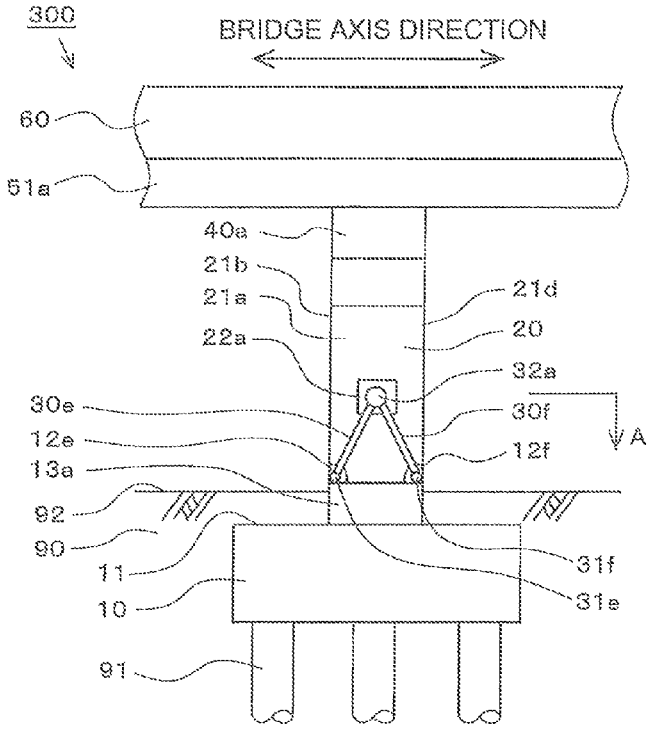
FIG. 8 is a left side view illustrating a bridge pier structure according to Embodiment 3 of the present invention.
Figure 9:
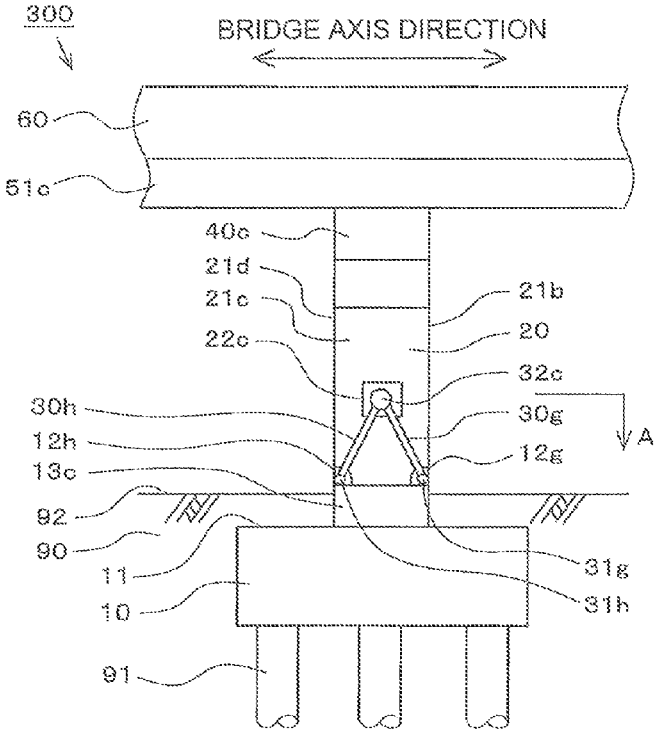
FIG. 9 is a right side view illustrating the bridge pier structure according to Embodiment 3 of the present invention.
Figure 10:
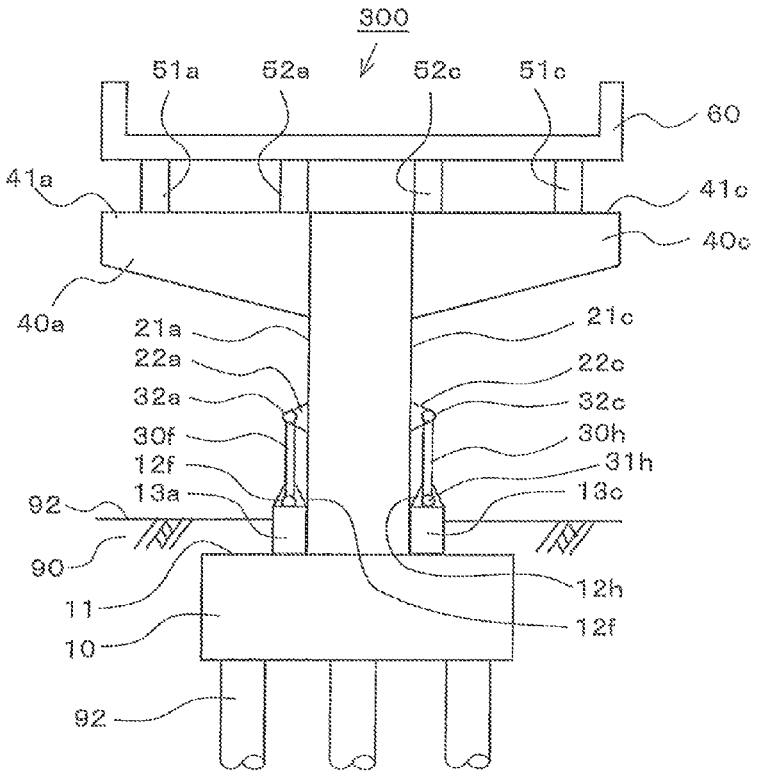
FIG. 10 is a front view illustrating the bridge pier structure according to Embodiment 3 of the present invention.
Figure 11:
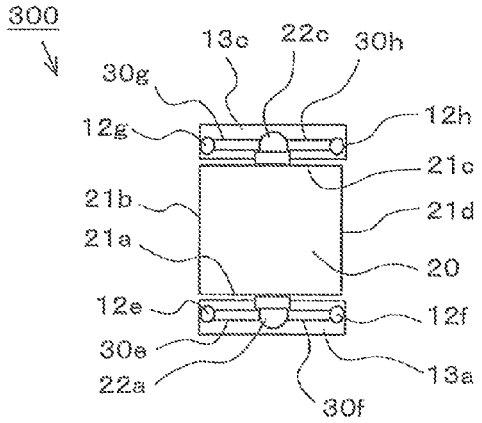
FIG. 11 is a cross-sectional view of a plan view illustrating the bridge pier structure according to Embodiment 3 of the present invention (along arrow A in FIG. 8).

FIGS. 8 to 11 illustrate a bridge pier structure according to Embodiment 3 of the present invention. FIG. 8 is a left side view, FIG. 9 is a right side view, FIG. 10 is a front view, and FIG. 11 is a cross-sectional view of a plan view (along arrow A in FIG. 8). Parts the same as or corresponding to those in Embodiment 1 are designated by the same reference signs, and description of parts thereof will be omitted. Further, respective parts are schematically illustrated, and the present invention is not limited to the illustrated embodiment (in shape and relative size).

(Bridge Pier Structure)

In FIGS. 8 to 11, a bridge pier structure 300 includes the bases 13*a* and 13*c* along the bridge pier side surfaces 21*a* and 21*c* of the bridge pier 20 on the upper surface 11 of the footing 10, and has no bases along the bridge pier side surfaces 21*b* and 21*d*. Further, dampers 30*e* and 30*f* are disposed parallel to the bridge pier side surface 21*a*, and dampers 30*g* and 30*h* are disposed parallel to the bridge pier side surface 21*c*. No dampers are disposed along the bridge pier side surfaces 21*b* and 21*d*.

The configurations other than the configuration for disposing the dampers 30*e*, 30*f*, 30*g*, and 30*h* are the same as those in the bridge pier structure 200 (Embodiment 2). Further, the dampers 30*e*, 30*f*, 30*g*, and 30*h* are the same as the dampers 30. Further, in the following description of members having the same structure, the suffixes "e," "f," "g," and "h" added to the reference signs of the members and parts may be omitted for the convenience of description.

Footing brackets 12*e* and 12*f* each including a not-illustrated footing pin hole are installed to the base 13*a* extending along the bridge pier side surface 21*a*, and a bridge pier bracket 22*a* including a not-illustrated pier pin hole is installed at the center in the horizontal direction of the bridge pier side surface 21*a*.

Further, similarly, Footing brackets 12*g* and 12*h* each including a not-illustrated footing pin hole are installed to the base 13*c* extending along the bridge pier side surface 21*c*, and a bridge pier bracket 22*c* including a not-illustrated pier pin hole is installed at the center in the horizontal direction of the bridge pier side surface 21*c*.

On the side of the bridge pier side surface 21*a*, a lower pin 31*e* inserted in a damper pin hole (not illustrated) provided in the damper 30*e* and the corresponding footing pin hole forms a footing-side pin structure, and the upper pin 32*a* inserted in a damper pin hole (not illustrated) provided in the damper 30*e* and the pier pin hole forms a pier-side pin structure. Similarly, a lower pin 31*f* inserted in a damper pin hole (not illustrated) provided in the damper 30*f* and the corresponding footing pin hole forms a footing-side pin structure, and the upper pin 32*a* inserted in a damper pin hole (not illustrated) provided in the damper 30*f* and the pier pin hole forms a pier-side pin structure.

The dampers 30*e* and 30*f* are therefore pin-connected by the upper pin 32*a* at the upper ends thereof, forming an inverse V shape.

Further, similarly, on the side of the bridge pier side surface 21*c*, the dampers 30*g* and 30*h* are pin-connected by the upper pin 32*c* at the upper ends thereof, forming an inverse V shape.

(Operations)

Figure 12:
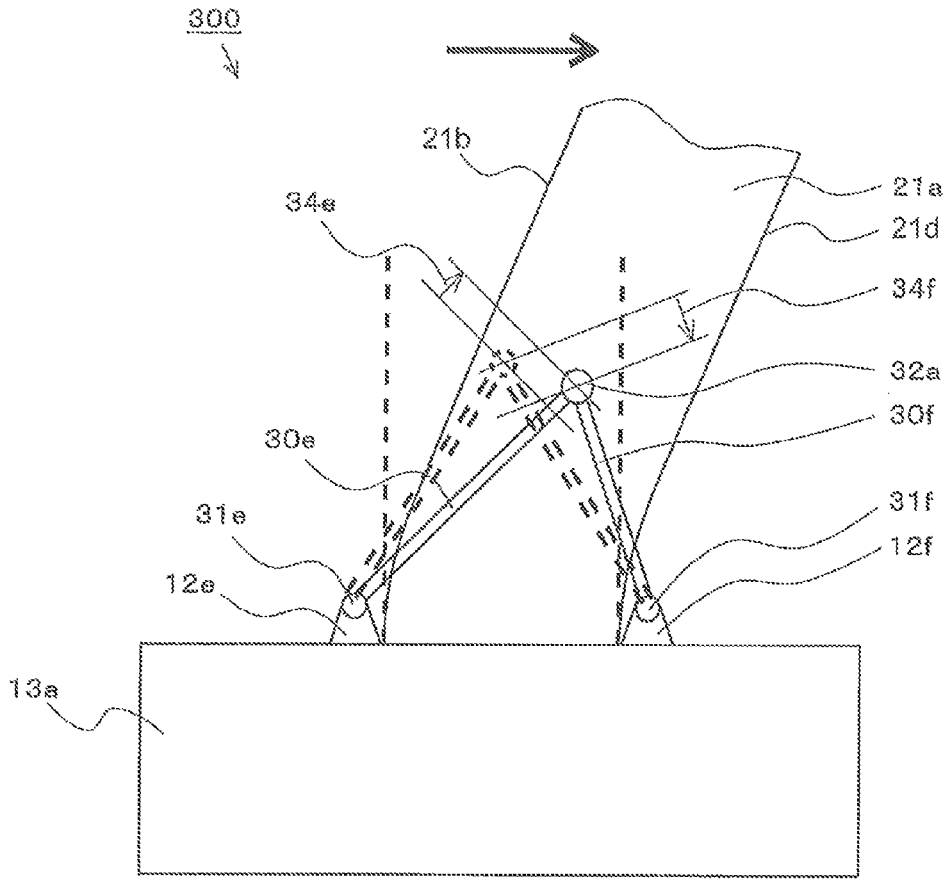
FIG. 12 is a left side view illustrating the bridge pier structure according to Embodiment 3 of the present invention, depicting deformation of the bridge pier structure in an earthquake.

FIG. 12 is a left side view illustrating the bridge pier structure 300 according to Embodiment 3 of the present invention, depicting deformation of the bridge pier structure 300 in an earthquake. Respective parts are schematically illustrated, and the same parts as the parts illustrated in FIGS. 8 to 10 are designated by the same reference signs.

In FIG. 12, the bridge pier 20 (the bridge pier side surfaces 21*b* and 21*d*) is installed perpendicularly to the upper surface 11 of the footing 10 before the occurrence of the earthquake. Thus, the dampers 30*e* and 30*f* form oblique sides of an isosceles triangle (indicated by broken lines). The dampers 30*g* and 30*h* similarly form oblique sides of an isosceles triangle (not illustrated).

Then, as the earthquake occurs, an area of the bridge pier 20 close to the lower end thereof is bent to tilt relative to the upper surface 11 of the footing 10. Thus, respective upper end portions of the dampers 30*e* and 30*f* (both pin-connected by the upper pin 32*a*) move in a substantially horizontal direction (more accurately, slightly diagonally downward). Thus, the damper 30*e* extends by a distance represented as 34*e* (hereinafter referred to as the "extension amount"), while the damper 30*f* contracts by a distance represented as 34*f* (hereinafter referred to as the "contraction amount").

Further, similarly, on the side of the bridge pier side surface 21*c*, the damper 30*g* extends by the extension amount 34*e*, while the damper 30*h* contracts by the contraction amount 34*f* (not illustrated).

The bridge pier structure 300 therefore exhibits operations and effects similar to those of the bridge pier structures 100 and 200 (Embodiments 1 and 2).

Although the upper end portion of the damper 30*e* and the upper end portion of the damper 30*f* overlap each other in the foregoing description, the present invention is not limited thereto. The upper end portion of the damper 30*e* and the upper end portion of the damper 30*f* may be separated from each other, as long the distance between the upper end portion of the damper 30*e* and the upper end portion of the damper 30*f* is different from the distance between the lower end portion of the damper 30*e* and the lower end portion of the damper 30*f*. That is, the dampers 30*e* and 30*f* may be arranged in a trapezoidal shape. In this case, the distance between the upper end portions may be longer or shorter than the distance between the lower end portions.

Further, the dampers 30*e* and 30*f* may form a triangular shape, with the respective lower end portions of the dampers 30*e* and 30*f* overlapping each other.

Embodiment 4

Figure 13A:
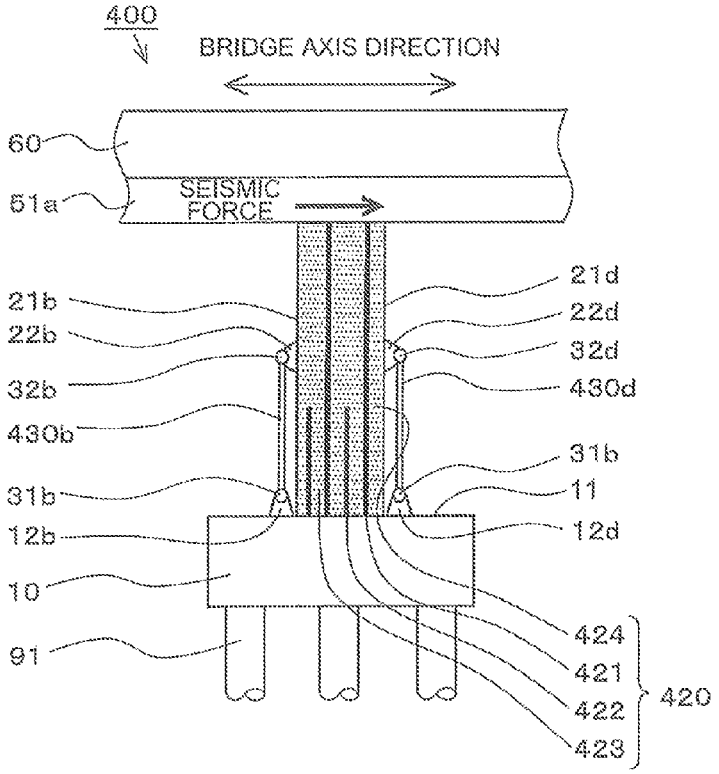
FIG. 13A is a side view illustrating a bridge pier structure according to Embodiment 4 of the present invention, depicting a section of a part thereof.
Figure 13B:
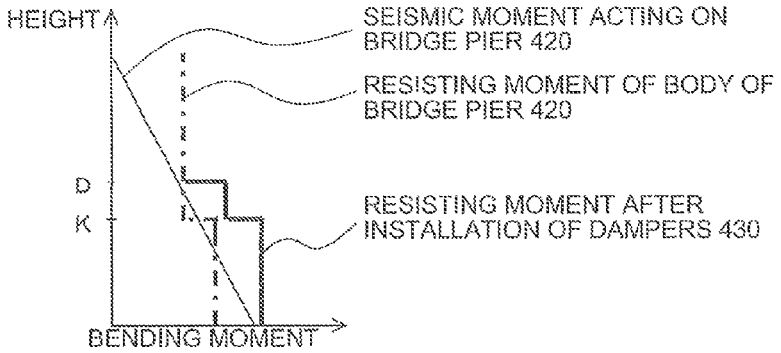
FIG. 13B is a moment diagram illustrating the bridge pier structure according to Embodiment 4 of the present invention, depicting the distribution of bending moment.
Figure 13C:
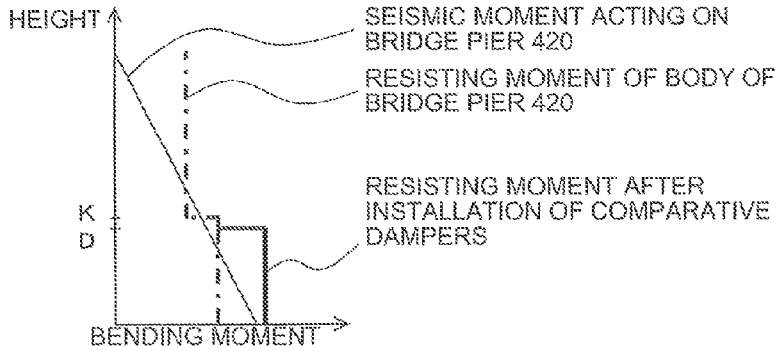
FIG. 13C is a moment diagram illustrating the bridge pier structure according to Embodiment 4 of the present invention, depicting the distribution of bending moment when comparative dampers are installed.
Figure 14:
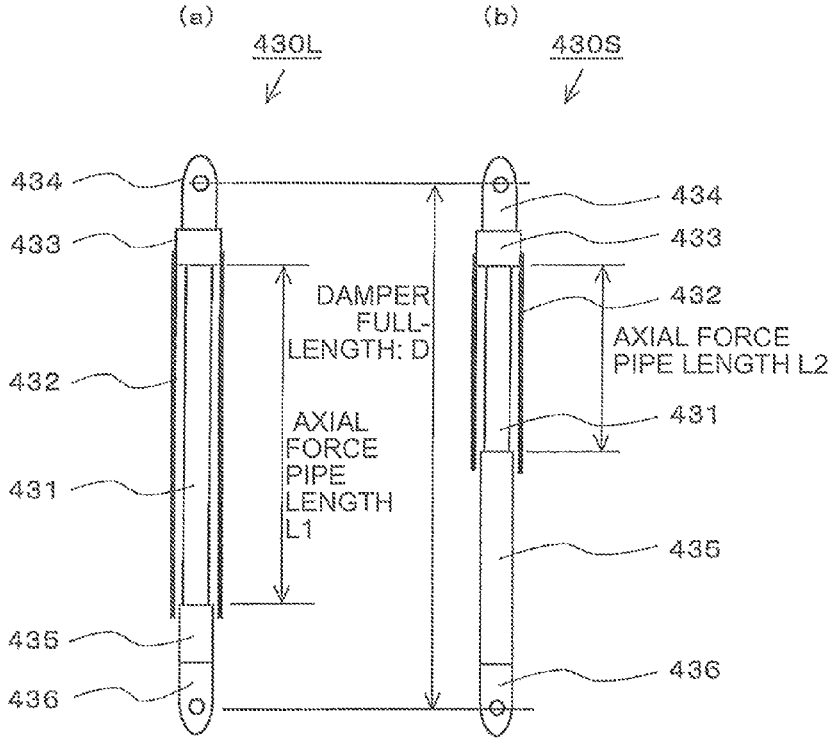
FIG. 14 illustrates the bridge pier structure according to Embodiment 4 of the present invention, and (a) and (b) are side views each depicting a part (damper) of the bridge pier structure.
Figure 15A:
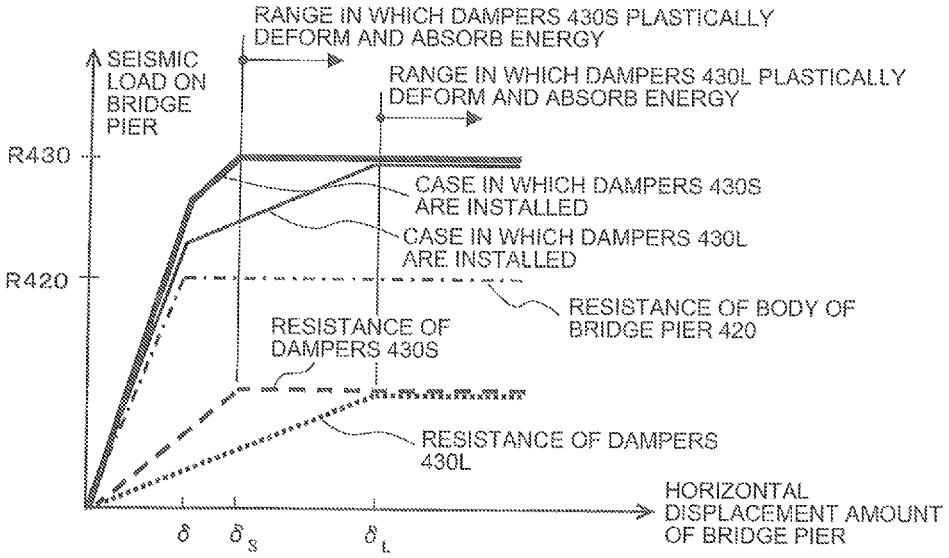
FIG. 15A is a correlation diagram illustrating the bridge pier structure according to Embodiment 4 of the present invention, depicting the relationship between a seismic load and a horizontal displacement amount.
Figure 15B:
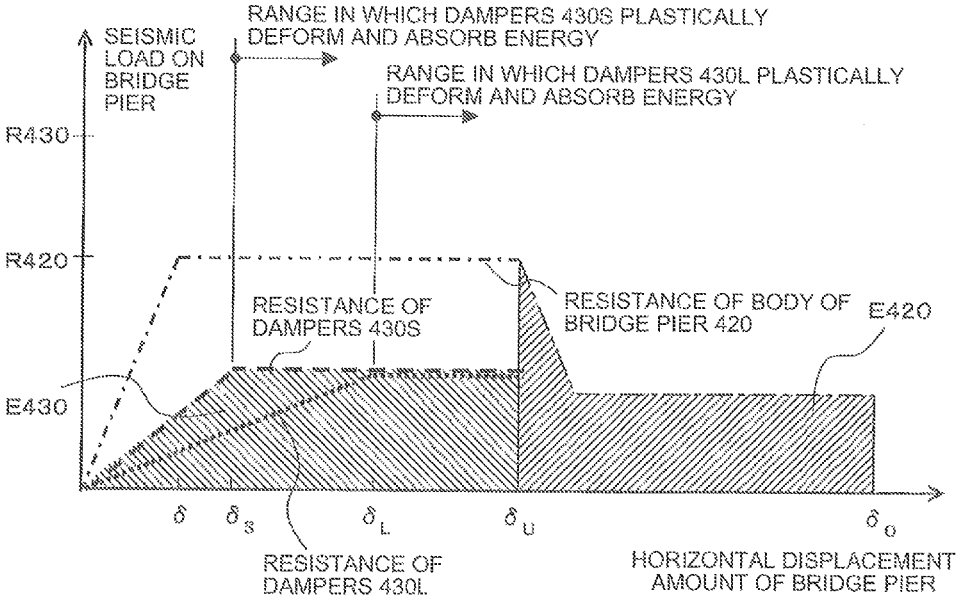
FIG. 15B is a correlation diagram illustrating the bridge pier structure according to Embodiment 4 of the present invention, depicting the relationship between force and a displacement amount for illustrating how to determine the length of a part (an axial force member of a damper) of the bridge pier structure.

FIGS. 13 to 15 illustrate a bridge pier structure according to Embodiment 4 of the present invention. FIG. 13A is a side view of the bridge pier structure depicting a section of a part thereof, FIG. 13B is a moment diagram depicting the distribution of bending moment, and FIG. 13C is a moment diagram illustrating the distribution of bending moment when comparative dampers are installed. In FIG. 14, (a) and (b) are side views each depicting a part (damper) of the bridge pier structure. FIG. 15A is a correlation diagram depicting the relationship between a seismic load and a horizontal displacement amount, and FIG. 15B is a correlation diagram depicting the relationship between force and a displacement amount for illustrating how to determine the length of a part (an axial force member of a damper) of the bridge pier structure.

Parts the same as or corresponding to those in Embodiment 1 are designated by the same reference signs, and description of parts thereof will be omitted. Respective parts are schematically illustrated, and the present invention is not limited to the illustrated embodiment (in shape and relative size).

(Cut-Off Section)

In a bridge pier structure 400 in FIG. 13A, the bridge pier 20 serving as a pillar member in the bridge pier structure 100 is replaced by a bridge pier 420 having a "cut-off section", and the dampers 30 is replaced by dampers 430.

That is, the bridge pier 420 includes full-length reinforcing bars 421 disposed over the full length of the bridge pier 420 in the height direction, lower reinforcing bars 422 disposed in a lower portion of the bridge pier 420 in the height direction, and concrete 423, and a cut-off section 424 is formed at a height corresponding to respective upper ends of the lower reinforcing bars 422. Further, on the bridge pier side surfaces 21*b* and 21*d* of the bridge pier 420, bridge pier brackets 22*b* and 22*d* are provided at positions higher than the cut-off section 424.

Further, respective upper end portions of the dampers 430*b* and 430*d* (also collectively referred to as the dampers 430) are connected to the bridge pier brackets 22*b* and 22*d*. That is, when the distance from the upper surface 11 of the footing 10 to the upper ends of the lower reinforcing bars 422 is referred to as the "minimum damper installation height K," the dampers 430 have a length covering the "minimum damper installation height K."

Although the description has been given of a case in which the dampers 430*b* and 430*d* are installed for the convenience of description, the present invention is not limited thereto. Thus, the same damper as the damper 430*b* may be each installed to four surfaces of the bridge pier 420.

(Resisting Moment)

In FIG. 13B, seismic bending moment acting on the bridge pier 420 (indicated by a right-downward sloping straight line) is small at an upper portion of the bridge pier 420 and increases toward the footing 10.

In accordance with this, the bridge pier 420 includes the "cut-off section 424," at which the amount of reinforcing bars is changed, at an intermediate position in the height direction of the bridge pier 420. Therefore, the bending resistance (resisting moment) of the bridge pier 420 is small at the upper portion of the bridge pier 420 and large at a lower portion of the bridge pier 420, and sharply changes at the cut-off section 424 (indicated by a dash-dotted line).

Further, since the dampers 430 are disposed in an area including the cut-off section 424 at which the sharp change in the resisting moment occurs, the value of the resisting moment is increased in an area not reinforced by the lower reinforcing bars 422 (same as the area between the heights K and D) (indicated by a thick solid line).

In FIG. 13C, if dampers shorter than the "minimum damper installation height K" (hereinafter referred to as the "comparative dampers") are installed, the value of the resisting moment is increased in the area lower than the cut-off section 424, that is, the area reinforced by the full-length reinforcing bars 421 and the lower reinforcing bars 422, but fails to be increased in an area higher than the cut-off section 424, that is, an area not reinforced by the lower reinforcing bars 422 (same as the area between the heights D and K) (indicated by a thick solid line).

(Shape of Dampers)

In FIG. 14A, the damper 430 (referred to as the "damper 430L" for the convenience of description) includes an axial force member 431 having an axial force pipe length L1, a stiffener 432 surrounding the axial force member 431, an upper ferrule 433 connected to respective upper end portions of the axial force member 431 and the stiffener 432, an upper clevis 434 connected to the upper ferrule 433, a lower ferrule/reinforcing pipe 435 connected to a lower end portion of the axial force member 431, and a lower clevis 436 connected to the lower ferrule/reinforcing pipe 435.

In (b) of FIG. 14, the damper 430 (referred to as the "damper 430S" for the convenience of description) is the same in structure as the damper 430L, but an axial force pipe length L2 of the axial force member 431 is shorter than the axial force pipe length L1 in the damper 430L, and the length of the lower ferrule/reinforcing pipe 435 is longer.

(Seismic Load)

In FIG. 15A, the vertical axis represents the seismic load on the bridge pier 420, and the horizontal axis represents the horizontal displacement amount of the bridge pier 420. The damper 430L with the long axial force member 431 elastically deforms until the horizontal displacement amount of the bridge pier 420 reaches a horizontal bridge pier displacement amount δL. After the horizontal displacement amount of the bridge pier 420 reaches the horizontal bridge pier displacement amount δL, the damper 430L plastically deforms under a constant load (indicated by a dotted line). Meanwhile, the damper 430S with the short axial force member 431 elastically deforms until the horizontal displacement amount of the bridge pier 420 reaches a horizontal bridge pier displacement amount δS, which less than the horizontal bridge pier displacement amount δL. After the horizontal displacement amount of the bridge pier 420 reaches the horizontal bridge pier displacement amount δS, the damper 430S plastically deforms under a constant load (indicated by a broken line).

Further, the body of the bridge pier 420 elastically deforms until the horizontal displacement amount of the bridge pier 420 reaches the horizontal bridge pier displacement amount δ. After the horizontal displacement amount of the bridge pier 420 reaches the horizontal bridge pier displacement amount δ, the body of the bridge pier 420 plastically deforms under a constant load (indicated by a dash-dotted line).

Thus, the seismic load supported by the bridge pier 420 equipped with the damper 430L changes at the horizontal bridge pier displacement amounts 6 and δL (indicated by a thin solid line). Further, the seismic load supported by the bridge pier 420 equipped with the damper 430S changes at the horizontal bridge pier displacement amounts δ and δS (indicated by a thick solid line).

That is, the yield extension/contraction amount of the axial force member 431 is proportional to the length of the axial force member 431. Further, it is possible to adjust the yield extension/contraction amount of the damper 430 by changing the length of the axial force member 431, even if the full length of the damper 430 is fixed.

In this case, the full length of the damper 430 needs to cover the "minimum damper installation height K." In this case, however, it is possible to provide a structure with good energy absorption performance by reducing the length of the axial force member 431 and increasing the length of the lower ferrule/reinforcing pipe 435.

In FIG. 15B, the seismic load supported by the body of the bridge pier 420 (to which the dampers 430 are not installed) linearly declines after the bridge pier 420 plastically deforms to an allowable displacement (same as allowable pillar member displacement) amount δu. Thereafter, the bridge pier 420 deforms with a constant value until a design displacement amount δ0 determined by the design energy of the bridge pier 420. That is, the bridge pier 420 absorbs energy E420 corresponding to the area indicated by left-downward sloping lines even after the bridge pier 420 is displaced to the allowable displacement amount δu.

Meanwhile, the damper 430S absorbs energy E430 corresponding to the area indicated by right-downward sloping lines during the displacement to the allowable displacement amount δu. Therefore, the length of the axial force member 431 of the damper 430S is determined so that the energy E430 equals or exceeds in value the energy E420.

Embodiment 5

Figure 16:
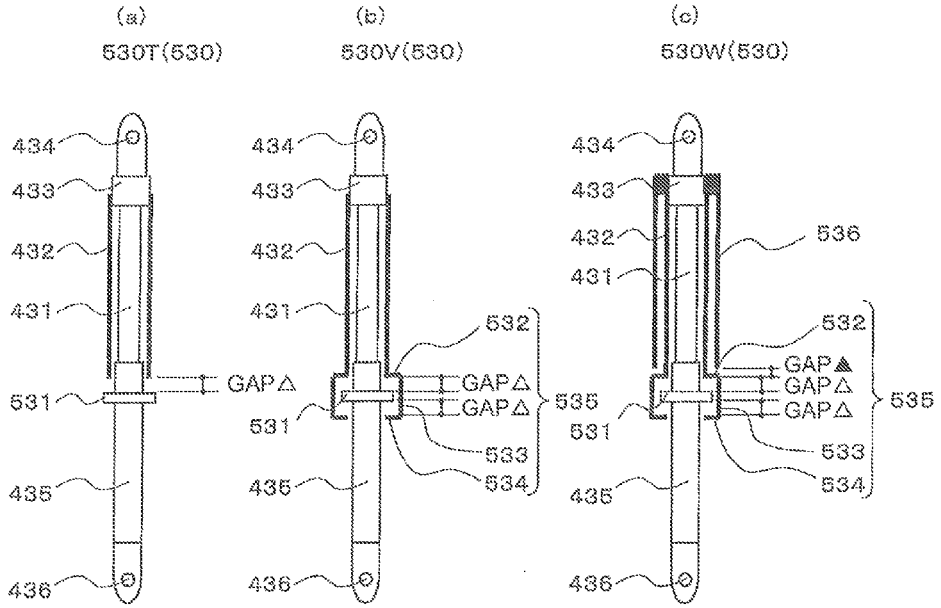
FIG. 16 illustrates a bridge pier structure according to Embodiment 5 of the present invention, and (a), (b), and (c) are side views each depicting a part (damper) of the bridge pier structure.
Figure 17:
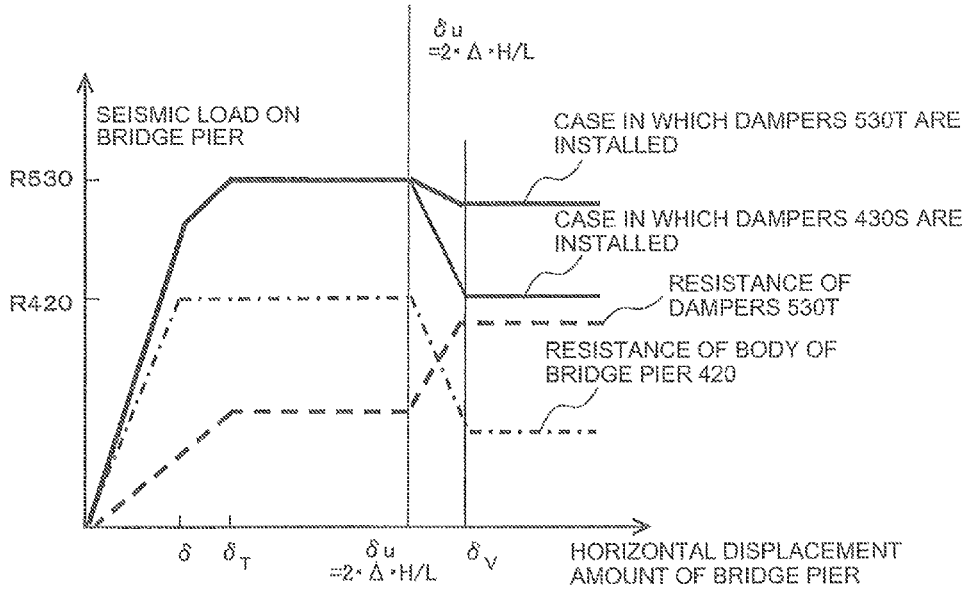
FIG. 17 is a correlation diagram illustrating the bridge pier structure according to Embodiment 5 of the present invention, depicting the relationship between a seismic load on a bridge pier and a horizontal displacement amount of the bridge pier.

FIGS. 16 and 17 illustrate a bridge pier structure according to Embodiment 5 of the present invention. In FIG. 16, (a), (b), and (c) are side views each depicting a part (damper) of the bridge pier structure. FIG. 17 is a correlation diagram illustrating the relationship between a seismic load on a bridge pier and a horizontal displacement amount of the bridge pier. Parts the same as or corresponding to those in Embodiment 4 are designated by the same reference signs, and description of parts thereof will be omitted.

In a not-illustrated bridge pier structure 500, the dampers 430 in the bridge pier structure 400 (Embodiment 4) are replaced by dampers 530T, 530V, or 530W described below. The parts other than this point are the same as those in the bridge pier structure 400. The changed parts will be described below.

(Stopper)

In (a) of FIG. 16, a stopper 531 projecting from the outer circumference of the lower ferrule/reinforcing pipe 435 of the damper 430S is installed to the damper 530T, and a gap Δ is formed between an upper surface of the stopper 531 and a lower end of the stiffener 432. After the axial force member 431 contracts and the lower end of the stiffener 432 comes into contact with the stopper 531, therefore, the axial force member 431 and the stiffener 432 both support compressive force.

(Reaction Force Member)

In (b) of FIG. 16, the stopper 531 projecting from the outer circumference of the lower ferrule/reinforcing pipe 435 of the damper 430S is installed to the damper 530V, and a reaction force member 535 is provided to the lower end of the stiffener 432. The reaction force member 535 includes an upper reaction force plate (same as upper reaction force portion) 532 forming the gap A from the upper surface of the stopper 531, a lower reaction force plate (same as lower reaction force portion) 534 forming the gap A from a lower surface of the stopper 531, and a reaction force sleeve 533 connecting the upper reaction force plate 532 and the lower reaction force plate 534 and housing the stopper 531.

After the axial force member 431 contracts and a lower surface of the upper reaction force plate 532 comes into contact with the upper surface of the stopper 531, therefore, the axial force member 431 and the stiffener 432 both support the compressive force. By contrast, after the axial force member 431 extends and an upper surface of the lower reaction force plate 534 comes into contact with the lower surface of the stopper 531, the axial force member 431 and the stiffener 432 both support tensile force.

(Second Stiffener)

In (c) of FIG. 16, the damper 530W has a second stiffener 536 surrounding the stiffener 432 of the damper 530V and installed to the upper ferrule 433.

Therefore, a gap ▲ is provided between a lower end of the second stiffener 536 and an upper surface of the upper reaction force plate 532. Thus, the axial force member 431 and the stiffener 432 are stiffened by the second stiffener 536, and the occurrence of buckling of the axial force member 431 and the stiffener 432 is suppressed. Further, after the axial force member 431 contracts and the lower surface of the upper reaction force plate 532 comes into contact with the upper surface of the stopper 531, the axial force member 431 and the stiffener 432 both support the compressive force. Further, if the compression is increased, the upper surface of the upper reaction force plate 532 comes into contact with the lower end of the second stiffener 536, and three members of the axial force member 431, the second stiffener 536, and the stiffener 432 support the compressive force.

Since the number of members sharing the compressive force is increased in the damper 530W, as described above, the compressive force acting on each of the members is reduced, and thereby the occurrence of bucking is suppressed.

In FIG. 17, the value of the gap Δ between the upper surface of the stopper 531 and the lower end of the stiffener 432 satisfies "$\delta u=2\cdot\Delta\cdot H/L$" in the damper 530T. Herein, δu represents the allowable displacement (same as allowable pillar member displacement) amount, H represents the height of the bridge pier 420, and L represents the interval between the dampers 530T facing each other (see FIG. 5).

When the compressive force acts on the damper 530T and the contraction amount reaches Δ, therefore, the lower end of the stiffener 432 comes into contact with the stopper 531. Thus, the compressive force acting thereafter is supported by both the axial force member 431 and the stiffener 432, and the seismic load is increased. Then, the displacement reaches δv, and the stiffener 432 starts to plastically deform (indicated by a broken line).

Therefore, the reduction of the seismic load after the displacement of the bridge pier 420 to the allowable displacement amount δu is less in the bridge pier 420 to which the dampers 530T are installed (indicated by a thick solid line) than in the bridge pier 420 to which the dampers 430S (indicated by a thin solid line) are installed.

Embodiment 6

Figure 18:
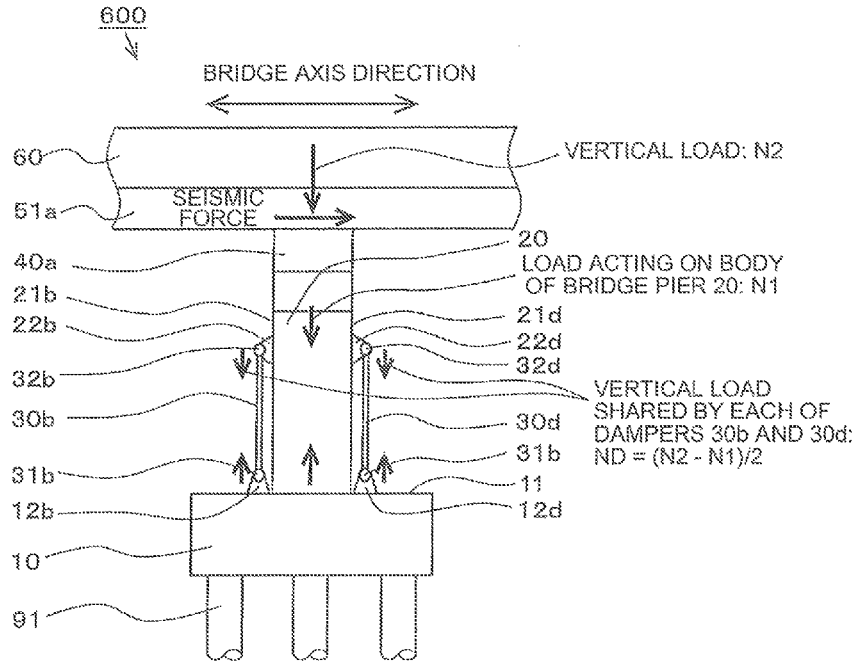
FIG. 18 is a side view illustrating a bridge pier structure according to Embodiment 6 of the present invention.
Figure 19:
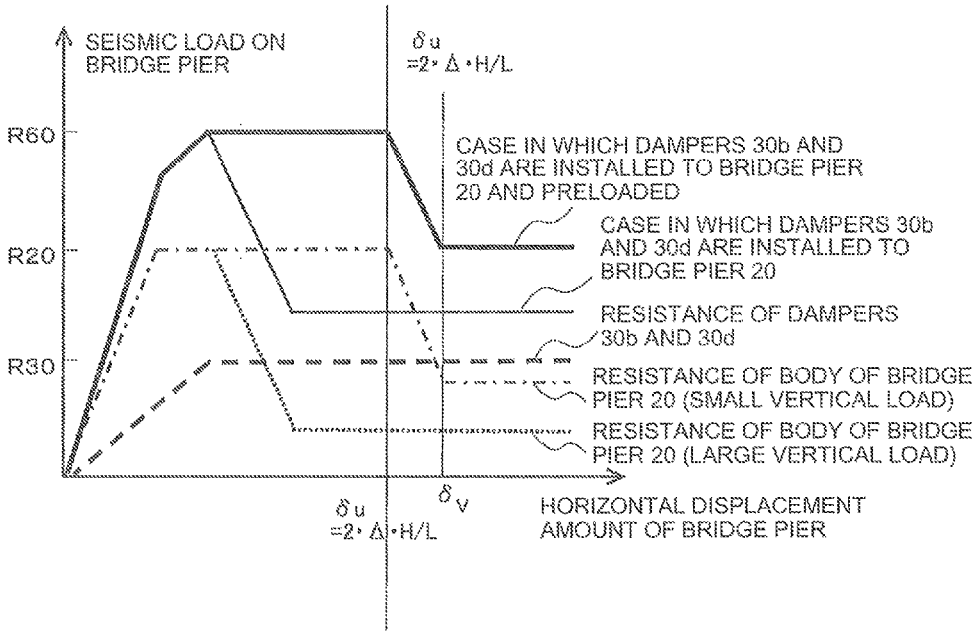
FIG. 19 is a correlation diagram illustrating the bridge pier structure according to Embodiment 6 of the present invention, depicting the relationship between a seismic load and a horizontal displacement amount.

FIGS. 18 and 19 illustrate a bridge pier structure according to Embodiment 6 of the present invention. FIG. 18 is a side view of the bridge pier structure, and FIG. 19 is a correlation diagram depicting the relationship between a seismic load and a horizontal displacement amount. Parts the same as or corresponding to those in Embodiment 1 are designated by the same reference signs, and description of parts thereof will be omitted. Respective parts are schematically illustrated, and the present invention is not limited to the illustrated embodiment (in shape and relative size).

(Preload)

In FIG. 18, a bridge pier structure 600 is the same as the bridge pier structure 100, but the dampers 30*b* and 30*d* are preloaded with force acting in a direction of lifting the floorboard 60. That is, a portion of the bridge pier 20 between the bridge pier brackets 22 and the upper surface 11 of the footing 10 is constantly (except in an earthquake) stretched by the dampers 30*b* and 30*d*.

Although the dampers 30*b* and 30*d* installed to the bridge pier 20 are previously contracted, a mechanism for preloading the dampers 30*b* and 30*d* is not limited. Further, although the configuration that preloads the dampers 30*b* and 30*d* is illustrated, the present invention is not limited thereto, and the dampers 30*a* and 30*c* may also be preloaded. Further, preloading may similarly be performed in the bridge pier structures 200 to 500 (Embodiments 2 to 5).

(Seismic Load)

In FIG. 19, the vertical axis represents a seismic load acting on the bridge pier 20, and the horizontal axis represents a horizontal displacement amount on the bridge pier 20. In FIG. 19, the resistance of the body of the bridge pier 20 is linearly reduced after becoming constant at resistance R20. Herein, if a vertical load acting on the bridge pier 20 is large, the range of the resistance R20 is small, and the resistance is reduced in a relatively small range of the horizontal displacement (indicated by a dotted line). By contrast, if the vertical load acting on the bridge pier 20 is small, the range of the resistance R20 is increased, and the resistance is reduced in a relatively large range of the horizontal displacement (indicated by a dash-dotted line).

Further, the resistance of the dampers 30*b* and 30*d* is linearly increased and thereafter maintained constant at resistance R30 (indicated by a broken line).

Therefore, if the dampers 30*b* and 30*d* not preloaded are installed to the bridge pier 20, that is, if the vertical load acting on the bridge pier 20 is large, the resistance is reduced at a relatively small value of the horizontal displacement amount (indicated by a thin solid line).

Meanwhile, if the preloaded dampers 30*b* and 30*d* are installed to the bridge pier 20, that is, if the vertical load acting on the bridge pier 20 is small, the resistance is reduced at a relatively large value of the horizontal displacement amount (indicated by a thick solid line). Herein, if the vertical load due to the own weight of the floorboard 60 and other factors and the preload provided to each of the dampers 30*b* and 30*d* are represented as "N2" and "ND," respectively, a vertical load N1 acting on a lower portion of the bridge pier 20 (an area lower than the bridge pier brackets 22*b* and 22*d*) is expressed as "N1=N2−2·ND."

INDUSTRIAL APPLICABILITY

The present invention reliably obtains a large plastic deformation amount (seismic energy absorption amount) and allows installation in a relatively small space, and thus is widely applicable as a vibration-damping, earthquake-resistant member of a civil engineering structure or an architectural structure, not limited to the bridge substructure or the like.

REFERENCE SIGNS LIST

10 footing 11 upper surface 12*a* to 12*h* footing bracket 13*a* to 13*d* base 20 bridge pier 21*a* to 21*d* bridge pier side surface 22*a* to 22*d* bridge pier bracket 30*a* to 30*h* damper 31*a* to 31*h* lower pin 32*a* to 32*d* upper pin 34*a* extension amount 34*c* contraction amount 34*e* extension amount 34*f* contraction amount 40*a*, 40*c* beam 41*a*, 41*c* upper surface 51*a*, 51*c* girder 52*a*, 52*c* girder 60 floorboard 90 ground 91 pile 92 ground surface 100 bridge pier structure (Embodiment 1) 200 bridge pier structure (Embodiment 2) 300 bridge pier structure (Embodiment 3) 400 bridge pier structure (Embodiment 4) 420 bridge pier 421 full-length reinforcing bar 422 lower reinforcing bar 423 concrete 424 cut-off section 430 damper 430L damper

430S damper 430*b* damper 430*d* damper 431 axial force member 432 stiffener 433 upper ferrule 434 upper clevis 434*d* upper clevis 435 lower ferrule/reinforcing pipe 436 lower clevis 500 bridge pier structure (Embodiment 5) 530T damper 530V damper

530W damper 531 stopper 532 upper reaction force plate 533 reaction force sleeve 534 lower reaction force plate 535 reaction force member 536 second stiffener 600 bridge pier structure (Embodiment 6)

The invention claimed is:

1. A bridge pier structure comprising:

a damper having damping characteristics;

a substructure joined with a lower end portion of the damper; and a pillar member provided upright on the substructure, a side surface of the pillar member being joined with an upper end portion of the damper, the damper being substantially parallel to the side surface of the pillar member.

2. The bridge pier structure of claim 1, wherein the lower end portion and the upper end portion of the damper each include a damper pin hole, wherein a substructure bracket including a substructure pin hole is installed to the substructure, wherein a pillar member bracket including a pillar member pin hole is installed to the side surface of the pillar member, wherein a lower pin inserted in the damper pin hole of the lower end portion of the damper and the substructure pin hole forms a lower pin structure configured to join the damper and the substructure, and wherein an upper pin inserted in the damper pin hole of the upper end portion of the damper and the pillar member pin hole forms an upper pin structure configured to join the damper and the pillar member.

3. The bridge pier structure of claim 1, wherein the pillar member has a rectangular cross section, and the side surfaces of the pillar member are flat surfaces, wherein a pair of the dampers is disposed parallel to at least one of the side surfaces of the pillar member, and wherein a distance between the upper end portions of the pair of the dampers is different from a distance between the lower end portions of the pair of the dampers.

4. The bridge pier structure of claim 2, wherein the substructure includes a base having an upper surface projecting from ground, and wherein the substructure bracket is provided on the upper surface of the base.

5. The bridge pier structure of claim 1, wherein the damper is an axial damper, a shear damper, a viscoelastic damper, a bending damper, a cylinder-piston damper, a buckling-restrained brace, an unbonded brace, a hysteresis damper, or a friction damper.

6. The bridge pier structure of claim 1, wherein the pillar member has a cut-off reinforced concrete structure including a full-length reinforcing bar disposed over a full length of the pillar member in a height direction and a lower reinforcing bar disposed in a lower area of the pillar member in the height direction, and the upper end portion of the damper is joined to the side surface of the pillar member at a position above an upper end of the lower reinforcing bar.

7. The bridge pier structure of claim 1, wherein the damper includes an axial force member, a stiffener stiffening the axial force member, a first connection member connected to one end portion of the axial force member and one end portion of the stiffener, and a second connection member connected to an other end portion of the axial force member, and wherein the axial force member has a length equal to or shorter than a length so that a value of energy absorbed by the pillar member when the damper is not installed to the pillar member and the pillar member deforms from an allowable pillar member displacement allowed for the pillar member to a maximum design displacement determined by design energy of the pillar member is equal to energy absorbed by the damper from start of deformation of the damper to displacement to a displacement corresponding to the allowable pillar member displacement.

8. The bridge pier structure of claim 7, wherein a stopper is formed to project from an outer circumference of the second connection member, and, when the axial force member contracts, the stopper comes into contact with an other end portion of the stiffener.

9. The bridge pier structure of claim 7, wherein a stopper is formed to project from an outer circumference of the second connection member, wherein an other end portion of the stiffener is formed with a first reaction force portion and a second reaction force portion facing each other across the stopper, and wherein the stopper comes into contact with the first reaction force portion of the stiffener when the axial force member contracts, and the stopper comes into contact with the second reaction force portion of the stiffener when the axial force member extends.

10. The bridge pier structure of claim 8, wherein the stiffener is stiffened by a second stiffener, and one end portion of the second stiffener is connected to the first connection member.

* * * * *